US010539357B2

(12) United States Patent
Kim

(10) Patent No.: US 10,539,357 B2
(45) Date of Patent: Jan. 21, 2020

(54) REFRIGERATOR AND METHOD OF CONTROLLING THE SAME

(71) Applicant: LG ELECTRONICS INC., Seoul (KR)

(72) Inventor: Kyeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 380 days.

(21) Appl. No.: 15/373,142

(22) Filed: Dec. 8, 2016

(65) Prior Publication Data

US 2017/0159990 A1 Jun. 8, 2017

(30) Foreign Application Priority Data

Dec. 8, 2015 (KR) ..... 10-2015-0174347

(51) Int. Cl.

| | |
|---|---|
| ***F25D 11/02*** | (2006.01) |
| ***F25D 17/06*** | (2006.01) |
| ***F25D 29/00*** | (2006.01) |
| ***F25B 5/02*** | (2006.01) |

(52) U.S. Cl.

CPC ..... *F25D 11/022* (2013.01); *F25B 5/02* (2013.01); *F25D 17/065* (2013.01); *F25D 29/00* (2013.01); *F25B 2400/06* (2013.01); *F25D 2323/021* (2013.01); *F25D 2600/02* (2013.01); *F25D 2700/121* (2013.01)

(58) Field of Classification Search

CPC ..... F25D 11/025; F25D 11/022; F25B 5/02
See application file for complete search history.

(56) References Cited

U.S. PATENT DOCUMENTS 5,704,221 A * 1/1998 Lego ..... F25B 5/02 62/276
2006/0130494 A1* 6/2006 Dube ..... F25B 47/022 62/81
2007/0271937 A1* 11/2007 Kang ..... F25B 41/04 62/205

(Continued)

FOREIGN PATENT DOCUMENTS

CN 102798245 11/2012
CN 103542686 1/2014

(Continued)

OTHER PUBLICATIONS

Extended European Search Report in European Application No. 16202715.5, dated Apr. 10, 2017, 8 pages (with English translation).

(Continued)

*Primary Examiner* — Nelson J Nieves
(74) *Attorney, Agent, or Firm* — Fish & Richardson P.C.

(57) ABSTRACT

A refrigerator includes a freezing compartment and a refrigerating compartment. The refrigerator also includes a first refrigeration cycle system and a second refrigeration cycle system, the first refrigeration cycle system configured to cool the freezing compartment of the refrigerator and the second refrigeration cycle system configured to cool the refrigerating compartment of the refrigerator. The refrigerator also includes an auxiliary evaporator configured to supply cool air into the refrigerating compartment based on a portion of refrigerant circulating within the first refrigeration cycle that cools the freezing compartment.

9 Claims, 8 Drawing Sheets

(56) References Cited

U.S. PATENT DOCUMENTS

2008/0190123 A1* 8/2008 Li ..... F25D 29/00 62/129
2009/0151375 A1* 6/2009 Tarr ..... F25D 11/025 62/180
2009/0158768 A1* 6/2009 Rafalovich ..... F25D 11/025 62/434
2010/0037650 A1* 2/2010 Lee ..... F25B 5/00 62/498
2011/0094246 A1 4/2011 Pham et al.
2012/0272674 A1* 11/2012 Lim ..... F25D 29/00 62/218
2013/0019623 A1* 1/2013 Jo ..... F25D 11/025 62/190
2013/0047659 A1* 2/2013 Kim ..... F25D 11/022 62/441
2013/0061620 A1* 3/2013 Li ..... F25B 5/02 62/126
2013/0247601 A1* 9/2013 Burns ..... F25B 5/02 62/115
2014/0007612 A1* 1/2014 Kim ..... F25B 39/04 62/498
2014/0013779 A1* 1/2014 Cho ..... F25D 11/02 62/56
2014/0245758 A1* 9/2014 Gu ..... F25D 29/00 62/56
2015/0121926 A1* 5/2015 Lee ..... F25B 5/02 62/157
2015/0121949 A1* 5/2015 Heo ..... F25B 39/04 62/510
2015/0338138 A1* 11/2015 Buter ..... F25D 11/025 62/3.1
2015/0354860 A1* 12/2015 Kacmaz ..... F25D 11/022 62/196.1
2016/0040896 A1* 2/2016 Hong ..... F24F 1/005 165/221
2016/0320113 A1* 11/2016 Sekiya ..... F25B 49/02
2017/0219254 A1* 8/2017 Sul ..... F25B 5/02
2017/0241693 A1* 8/2017 Tajika ..... F25B 47/022
2017/0314839 A1* 11/2017 van Beek ..... F25D 11/006

FOREIGN PATENT DOCUMENTS

CN 203980771 12/2014
CN 104344587 2/2015
KR 10-2002-0038171 5/2002
KR 10-2013-0094020 8/2013
KR 10-2014-0006681 A 1/2014
KR 20150017182 2/2015

OTHER PUBLICATIONS

Chinese Office Action in Chinese Appln. No. 201611121509.7, dated Dec. 28, 2019, 15 pages (with English translation).

* cited by examiner

REFRIGERATOR AND METHOD OF CONTROLLING THE SAME

CROSS-REFERENCE TO RELATED APPLICATIONS

This application claims an earlier filing date and right of priority to Korean Patent Application No. 10-2015-0174347 filed on Dec. 8, 2015 in the Korean Intellectual Property Office, the contents of which is incorporated herein by reference in its entirety.

TECHNICAL FIELD

The present disclosure relates to a refrigerator and a method of controlling the same.

BACKGROUND

In general, a refrigerator includes a plurality of storage compartments to refrigerate or freeze food items. One or more of the storage compartments can be opened such that food can be inserted and withdrawn. The plurality of storage compartments generally includes a freezing compartment for freezing food and/or a refrigerating compartment for refrigerating food.

A refrigerator is commonly driven by a freezing system in which refrigerant is circulated. In some refrigerators, a first refrigeration cycle for a freezing compartment is provided separately from a second refrigeration cycle for a refrigerating compartment. A typical freezing system includes a compressor, a condenser, an expansion device, and an evaporator. Some evaporators include a first evaporator provided at one side of the refrigerating compartment and a second evaporator provided at one side of the freezing compartment.

SUMMARY

Systems and techniques are disclosed that enable a refrigerator that selectively supplies cool air into a refrigerating compartment of the refrigerator using a portion of refrigerant circulating within a refrigeration cycle that cools a freezing compartment of the refrigerator.

In one aspect, a refrigerator includes a main body defining therein a freezing compartment and a refrigerating compartment. The refrigerator may include a first refrigeration cycle system and a second refrigeration cycle system. The first refrigeration cycle system may include: a first compressor configured to compress a first refrigerant; a first condenser configured to condense refrigerant discharged from the first compressor; a first expansion device configured to expand refrigerant discharged from the first condenser; and a first evaporator configured to evaporate refrigerant passing through the first expansion device and to supply cool air to the freezing compartment. The second refrigeration cycle system may include: a second compressor configured to compress second refrigerant; a second condenser configured to condense refrigerant discharged from the second compressor; a second expansion device configured to expand refrigerant discharged from the second condenser; and a second evaporator configured to evaporate refrigerant passing through the second expansion device and to supply cool air to the refrigerating compartment. The first refrigeration cycle system may further include: a branched flow channel branched from an outlet side of the first expansion device; and an auxiliary evaporator provided in the branched flow channel and configured to supply cool air to the refrigerating compartment.

In some implementations, the refrigerator may further include: a first evaporator inlet flow channel extending from the first expansion device to the first evaporator; and a valve device provided in the first evaporator inlet flow channel and connected to the branched flow channel.

In some implementations, the branched flow channel may extend from the valve device to the auxiliary evaporator.

In some implementations, the first refrigeration cycle system may further include a coupler provided at a suction side of the first compressor and connected to the branched flow channel. The branched flow channel may further extend from the auxiliary evaporator of the first refrigeration cycle system to the coupler.

In some implementations, the valve device may include a three-way valve.

In some implementations, the valve device may include: an inlet connected to an outlet side of the first expansion device; a first outlet connected to an inlet side of the first evaporator; and a second outlet connected to an inlet side of the auxiliary evaporator of the first refrigeration cycle system.

In some implementations, the refrigerator may further include at least one processor. The at least one processor may be configured to: determine a temperature of the refrigerating compartment; and control the valve device based on the temperature of the refrigerating compartment.

In some implementations, the at least one processor may further be configured to: determine whether the temperature of the refrigerating compartment does not exceed a reference temperature by an amount greater than or equal to a threshold temperature increment; and based on a determination that the temperature of the refrigerating compartment does not exceed the reference temperature by the amount greater than or equal to the threshold temperature increment, control a first operation of the second refrigeration cycle system. The first operation of the second refrigeration cycle system may include continuously driving the second compressor.

In some implementations, the at least one processor may further be configured to: determine that the temperature of the refrigerating compartment exceeds the reference temperature by the amount greater than or equal to the threshold temperature increment; and based on the determination that the temperature of the refrigerating compartment exceeds the reference temperature by the amount greater than or equal to the threshold temperature increment, perform a second operation of the first refrigeration cycle. The second operation of the first refrigeration cycle may include opening the first outlet and the second outlet of the valve device.

In some implementations, the at least one processor may further be configured to: during the second operation of the first refrigerating cycle, determine that the temperature of the refrigerating compartment is equal to or less than the reference temperature; and based on a determination that the temperature of the refrigerating compartment is equal to or less than the reference temperature during the second operation of the first refrigerating cycle, open the first outlet of the valve device and close the second outlet of the valve device.

In some implementations, the auxiliary evaporator may be provided adjacent to the second evaporator.

In another aspect, a method is disclosed for controlling a refrigerator that includes a main body defining a refrigerating compartment and a freezing compartment, the refrigerator further including a first refrigeration cycle system and a second refrigeration cycle system. The first refrigeration cycle system includes a first compressor configured to compress a first refrigerant, a first condenser configured to condense refrigerant discharged from the first compressor; a first expansion device configured to expand refrigerant discharged from the first condenser, and a first evaporator configured to evaporate refrigerant passing through the first expansion device and to supply cool air to the freezing compartment. The second refrigeration cycle system includes a second compressor configured to compress second refrigerant, a second condenser configured to condense refrigerant discharged from the second compressor, a second expansion device configured to expand refrigerant discharged from the second condenser, a second evaporator configured to evaporate refrigerant passing through the second expansion device and to supply cool air to the refrigerating compartment. The method may include: determining, by at least one processor, that a temperature of the refrigerating compartment exceeds a reference temperature by an amount greater than or equal to a threshold temperature increment. The method may further include: based on a determination that the temperature of the refrigerating compartment exceeds the reference temperature by an amount greater than or equal to the threshold temperature increment: evaporating, by the first evaporator of the first refrigeration cycle system, the first refrigerant circulated in the first refrigeration cycle system to generate cool air; and supplying the generated cool air from the first evaporator to the refrigerating compartment via an auxiliary evaporator.

In some implementations, the refrigerator may further include an auxiliary evaporation fan that is provided at one side of the auxiliary evaporator and that is configured to blow cool air of the refrigerating compartment toward the auxiliary evaporator. Supplying the cool air to the refrigerating compartment may include driving the auxiliary evaporation fan.

In some implementations, the first refrigeration cycle system may further include a three-way valve configured to supply at least a portion of the first refrigerant to the auxiliary evaporator. A first operation state of the three-way valve may include an operation for opening a first outlet and a second outlet of the three-way valve to supply the first refrigerant to the first evaporator and to the auxiliary evaporator based on the temperature of the refrigerating compartment exceeding the reference temperature by the amount greater than or equal to the threshold temperature increment.

In some implementations, a second operation state of the three-way valve may include an operation for closing the second outlet of the three-way valve to stop a supply of the first refrigerant to the auxiliary evaporator based on the temperature of the refrigerating compartment being equal to or less than the reference temperature.

The details of one or more implementations are set forth in the accompanying drawings and the description below. Other features will be apparent from the description and drawings, and from the claims. The description and specific examples below are given by way of illustration only, and various changes and modifications will be apparent.

DETAILED DESCRIPTION

Figure 1:
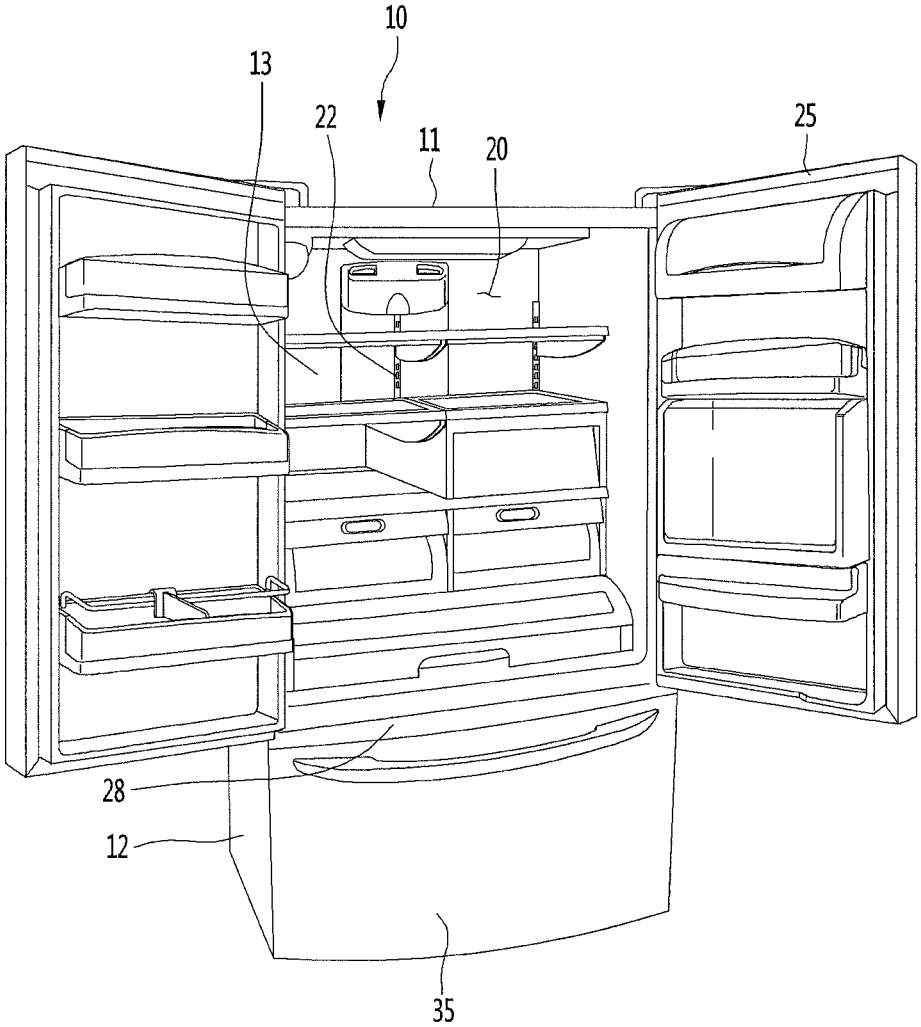
FIG. 1 is a perspective view showing an example configuration of a refrigerator according to some implementations.

Systems and techniques are disclosed that provide a refrigerator implementing a first refrigeration cycle system and a second refrigeration cycle system. The first refrigeration cycle system is configured to cool a freezing compartment of the refrigerator. The second refrigeration cycle system is configured to cool a refrigerating compartment of the refrigerator.

In some implementations, the refrigerator also includes an auxiliary evaporator configured to supply additional cool air into the refrigerating compartment utilizing a portion of refrigerant circulating within the first refrigeration cycle that cools the freezing compartment. The auxiliary evaporator may provide the additional cool air into the refrigerating compartment in a selective and temporary manner, for example based on a temperature of the refrigerating compartment exceeding a threshold.

As such, a refrigerator described herein may maintain a low temperature in the refrigerating compartment of the refrigerator with minimal temperature fluctuations. Furthermore, the refrigerator may achieve such low-temperature maintenance while also conserving energy by selectively supplying additional cool air into the refrigerating compartment based on the temperature of the refrigerating compartment exceeding a threshold temperature.

Some refrigerators utilize a refrigeration cycle in which a compressor is controlled to intermittently operate, such that operation of the compressor is stopped when an internal temperature thereof falls below a nominal or set temperature, and such that the compressor is driven again when the temperature exceeds the nominal or set temperature. Such refrigerators may suffer from a deterioration in cycle efficiency due to intermittent on/off operation of the compressor.

A refrigerator described herein may reduce such on/off inefficiencies by utilizing a low-cooling capacity compressor to continuously provide cool air in the refrigerating compartment. The low-cooling capacity of the compressor may help conserve energy despite operating in a continuous manner. In addition, as described above, when the temperature of the refrigerating compartment exceeds a threshold temperature, additional cool air may be supplied into the refrigerating compartment by utilizing a portion of refrigerant that cycles for the freezing compartment.

In addition, such continuous operation of the compressor may help reduce fluctuations in temperature of the refrigerating compartment. In refrigerators that use an intermittent on/off operation control method, the compressor is powered on or off when the internal temperature thereof reaches an upper temperature limit or a lower temperature limit, resulting in large changes in internal temperature of the compartment that may degrade freshness of food stored in the refrigerating compartment.

Such problems may be addressed by operating the compressor in a continuous manner, as described above and detailed further below, thereby improving cycle efficiency and decreasing fluctuations in internal temperature of the refrigerating compartment.

Furthermore, compared with 2-cycle refrigerators that utilize a high-cooling-capacity compressor to maintain low temperatures, the systems and techniques described herein enable implementation of a low-cooling capacity compressor that reduces energy usage while maintaining low temperatures.

The refrigerator and the method of controlling the same according to implementations described herein may have the following effects.

First, a compressor having lower cooling capacity than conventional compressors for cooling a refrigerating compartment may be used.

Second, a compressor for the refrigerating compartment may continuously operate to maintain the refrigerating compartment at a nominal or set temperature, thereby improving cycle efficiency and reducing fluctuations in internal temperature of the refrigerating compartment.

Third, the refrigerating compartment may be supplied with additional cool air from an auxiliary evaporator that branches from a refrigeration cycle that cools a freezing compartment of the refrigerator. The auxiliary evaporator may be provided adjacent to the evaporator of the refrigerating compartment, thereby rapidly coping with overload of the refrigerating compartment that increases a temperature therein.

Hereinafter, a bottom freezer type refrigerator in which a freezing compartment is provided under a refrigerating compartment will be described. However, the present disclosure is not limited to a bottom freezer type refrigerator and is applicable to other types of refrigerators, such as a top mount type refrigerator in which a freezing compartment is provided on a refrigerating compartment, or a side-by-side type refrigerator in which a freezing compartment and a refrigerating compartment are provided side by side. In addition, the present disclosure may be applied to refrigerators including various types of doors for opening and closing the refrigerating compartment and freezing compartment.

Figure 2:
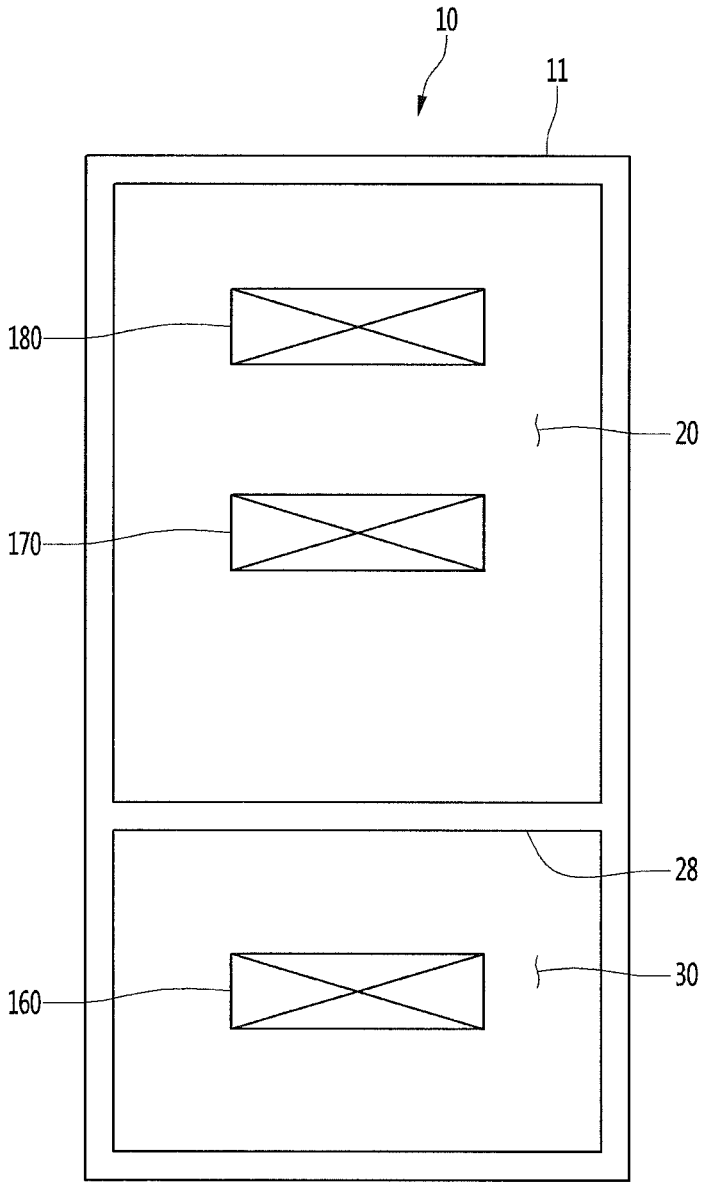
FIG. 2 is a view showing an example arrangement of an evaporator in a refrigerator according to some implementations.

FIG. 1 is a perspective view showing an example configuration of a refrigerator, and FIG. 2 is a view showing an example arrangement of an evaporator in a refrigerator according to some implementations.

Referring to the examples in FIGS. 1 and 2, refrigerator 10 includes main body 11 forming a storage compartment. The storage compartment includes a refrigerating compartment 20 and a freezing compartment 30. In the examples of FIGS. 1 and 2, the refrigerating compartment 20 is provided above the freezing compartment 30. The refrigerating compartment 20 and the freezing compartment 30 may be partitioned by a partition wall 28.

The refrigerator 10 includes a refrigerating compartment door 25 for opening and closing the refrigerating compartment 20 and a freezing compartment door 35 for opening and closing the freezing compartment 30. In the examples of FIGS. 1 and 2, refrigerating compartment door 25 is rotatably hinged to the main body 11 and freezing compartment door 35 is of a drawer type and may be withdrawn forwardly.

The main body 11 includes an outer case 12 forming an outer appearance of the refrigerator 10 and an inner case 13 provided inside the outer case 12 and forming at least one of an inner surface of the refrigerating compartment 20 or the freezing compartment 30. An insulator may be provided between the outer case 12 and the inner case 13.

The refrigerator 10 may also include refrigerating compartment cool-air discharger 22 for discharging cool air into the refrigerating compartment 20. The refrigerating compartment cool-air discharger 22 may be formed in a rear wall of the refrigerating compartment 20. In addition, refrigerator 10 may include a freezing compartment cool-air discharger that discharges cool air into the freezing compartment 30 and that is formed in a rear wall of the freezing compartment 30.

The refrigerator 10 includes a first evaporator 160 provided at the rear side of the freezing compartment 30 to cool the freezing compartment 30 and a plurality of evaporators 170 and 180 provided at the rear side of the refrigerating compartment 20 to cool the refrigerating compartment 20. The plurality of evaporators 170 and 180 includes a second evaporator 180 and an auxiliary evaporator 170 to cool the refrigerating compartment 20.

For example, the first evaporator 160 may be a freezing compartment evaporator to cool the freezing compartment 30. The second evaporator 180 and the auxiliary evaporator 170 may be refrigerating compartment evaporators for cooling the refrigerating compartment 20. In some implementations in which the refrigerating compartment 20 is provided above the freezing compartment 30, the second evaporator 180 and the auxiliary evaporator 170 may be provided at the upper side of the first evaporator 160.

The second evaporator 180 and the auxiliary evaporator 170 may be provided at the rear side of the refrigerating compartment 20 in an upper-and-lower direction or a right-and-left direction although implementations are not limited thereto.

Cool air generated by the second evaporator 180 and the auxiliary evaporator 170 may be supplied to the refrigerating compartment 20 through the refrigerating compartment cool-air discharger 22. Cool air generated by the first evaporator 160 may be supplied to the freezing compartment 30 through a freezing compartment cool-air discharger.

In some implementations, refrigerator 10 may include a mechanical compartment in which one or more parts of the refrigerator are provided, for example at a rear lower side of the refrigerator 10, such as a rear side of the freezing compartment 30. For example, a compressor and a condenser may be provided in the mechanical compartment.

Hereinafter, the configurations and functions of the refrigeration cycles including the evaporators will be described in greater detail with reference to the drawings.

Figure 3:
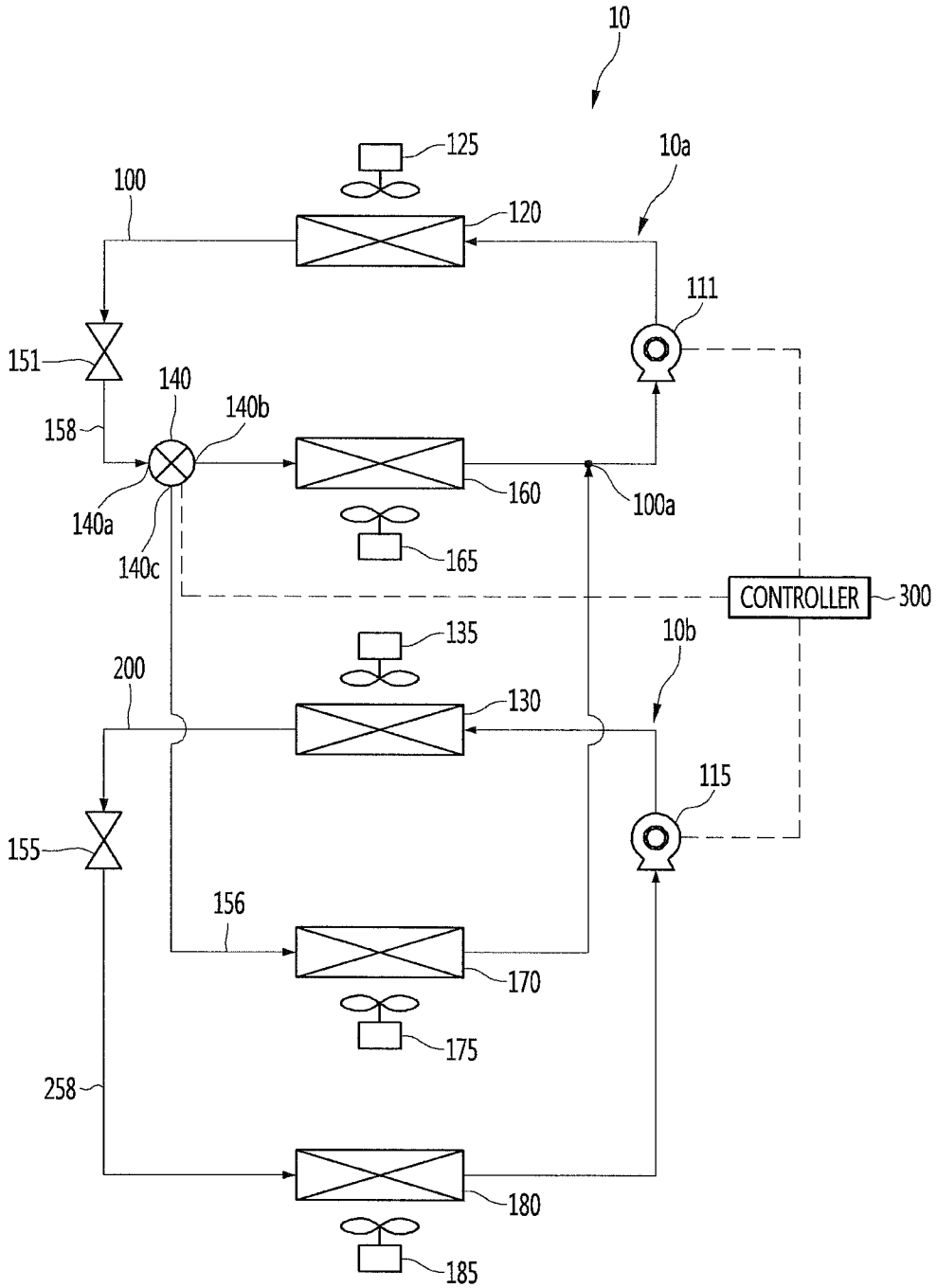
FIG. 3 is a systematic view showing example configurations of the refrigeration cycles of a refrigerator according to some implementations.

FIG. 3 is a systematic view showing example configurations of the refrigeration cycles of a refrigerator according to some implementations. Referring to FIG. 3, the refrigerator 10 includes a first refrigeration cycle **10*a* to primarily cool the freezing compartment 30 and a second refrigeration cycle 10*b* to primarily cool the refrigerating compartment 20**.

In some implementations, first refrigeration cycle **10*a* may be configured to, in addition to cooling the freezing compartment 30, also further supply cool air into the refrigerating compartment 20. For example, first refrigeration cycle 10*a* may utilize auxiliary evaporator 170 to further supply cool air into the refrigerating compartment 20. In some implementations, first refrigeration cycle 10***a* may selectively supply cool air into refrigerating compartment 20 under certain conditions, such as when the temperature of refrigerating compartment 20 is equal to or greater than a reference temperature. In some scenarios, this condition may occur when the refrigerating compartment 20 is overloaded with food items.

As such, first refrigeration cycle 10*a* may perform a dual function of (a) supplying cool air primarily into freezing compartment 30, and (b) supplying additional cool air into refrigerating compartment 20 to supplement second refrigeration cycle 10*b* as appropriate. Details of further supplying cool air into the refrigerating compartment 20 through first refrigeration cycle 10*a* will be described below.

First refrigerant may be circulated in the first refrigeration cycle 10*a* and second refrigerant may be circulated in the second refrigeration cycle 10*b*. In some implementations, the first refrigerant in the first refrigeration cycle 10*a* is not mixed with the second refrigerant in the second refrigeration cycle 10*b*. In such scenarios, the first refrigeration cycle 10*a* and the second refrigeration cycle 10*b* are independently driven according to change in temperatures of the freezing compartment 30 and refrigerating compartment 20.

In some implementations, first refrigeration cycle 10*a* may be configured as a low-pressure cycle having relatively low evaporation pressure to cool the freezing compartment 30. Conversely, second refrigeration cycle 10*b* may be configured as a high-pressure cycle having relatively high evaporation pressure to cool the refrigerating compartment 20.

As shown in the example of FIG. 3, the first refrigeration cycle 10*a* may include a first compressor 111 for compressing low-temperature, low-pressure first refrigerant into high-temperature, high-pressure gaseous first refrigerant. A first condenser 120 may be provided at the outlet side of the first compressor 111 to condense the gaseous first refrigerant into liquefied first refrigerant.

The first refrigeration cycle 10*a* further includes a first expansion device 151 provided at the outlet side of the first condenser 120 to expand the liquefied first refrigerant into low-temperature, low-pressure first refrigerant. As a result, first refrigerant passing through the first expansion device 151 may include two-phase refrigerant which is a mixture of gaseous first refrigerant and liquefied first refrigerant.

The first refrigeration cycle 10*a* further includes a first evaporator 160*a* provided at the outlet side of the first expansion device 151 to evaporate the first refrigerant passing through the first expansion device 151 into low-temperature, low-pressure gaseous refrigerant.

The first refrigeration cycle 10*a* further includes a first refrigerant flow channel 100 connecting the first compressor 111, the first condenser 120, the first expansion device 151 and the first evaporator 160 to guide flow of first refrigerant. The first refrigerant may be circulated along the first refrigerant flow channel 100.

The first refrigerant flow channel 100 includes a first evaporator inlet flow channel 158 extending from the outlet side of the first expansion device 151 to the inlet side of the first evaporator 160. In the first evaporator inlet flow channel 158, a valve device 140 may be mounted.

Valve device 140 may selectively control the flow of the first refrigerant into the first evaporator 160 and/or into the auxiliary evaporator 170. For example, the valve device 140 may include a three-way valve. As shown in the example of FIG. 3, the valve device 140 may include a first inlet 140*a* and two outlets such as first outlet 140*b* and second outlet 140*c*. The first outlet 140*b* may be connected to the first evaporator 160 and the second outlet 140*c* may be connected to the auxiliary evaporator 170. The first refrigerant flowing through the inlet 140*a* of the valve device 140 may be discharged through at least one of the first outlet 140*b* or the second outlet 140*c*. As such, the first refrigerant flowing into the valve device 140 may selectively flow to the first evaporator 160 via first outlet 140*b* or into the auxiliary evaporator 170 via second outlet 140*c*. In some scenarios, the first refrigerant flowing into the valve device 140 may flow into both first evaporator 160 and auxiliary evaporator 170.

The first refrigeration cycle 10*a* further includes a branched flow channel 156 branched from the valve device 140 to extend to the suction side of the first compressor 111. The auxiliary evaporator 170 may be mounted in the branched flow channel 156. In the example of FIG. 3, the branched flow channel 156 extends from the second outlet 140*c* of the valve device 140 to the auxiliary evaporator 170.

Using the above configuration, first refrigeration cycle 10*a* may supply first refrigerant into the first evaporator 160 to cool the freezing compartment 30 and, in addition, selectively supply first refrigerant into the auxiliary evaporator 170 to cool the refrigerating compartment 20. As such, by selectively supplying the first refrigerant into auxiliary evaporator 170 to cool refrigerating compartment 20, the first refrigeration cycle 10*a* may supplement the cooling operation of second refrigeration cycle 10*b* as appropriate.

The second refrigeration cycle 10*b* includes a second compressor 115 for compressing low-temperature, low-pressure second refrigerant into high-temperature, high-pressure gaseous second refrigerant. The second refrigeration cycle 10*b* also includes a second condenser 130 provided at the outlet side of the second compressor 115 to condense the gaseous second refrigerant into high-temperature, high-pressure liquefied second refrigerant.

The second refrigeration cycle 10*b* further includes a second expansion device 155 provided at the outlet side of the second condenser 130 to expand the liquefied second refrigerant into low-temperature, low-pressure second refrigerant. The second refrigerant passing through the second expansion device 155 may include two-phase refrigerant which is a mixture of gaseous second refrigerant and liquefied second refrigerant.

The second refrigeration cycle 10*b* further includes a second evaporator 180 provided at the outlet side of the second expansion device 155 to evaporate the second refrigerant passing through the second expansion device 155 into low-temperature, low-pressure gaseous second refrigerant.

The second refrigeration cycle 10*b* further includes a second refrigerant flow channel 200 connecting the second compressor 115, the second condenser 130, the second expansion device 155 and the second evaporator 180 to guide flow of second refrigerant. The second refrigerant may be circulated along the second refrigerant flow channel 200.

The first refrigerant flowing in first refrigeration cycle 10*a* and the second refrigerant flowing in second refrigeration cycle 10*b* may be of the same type or different types. The cooling capacity of the first compressor 111 may be greater than that of the second compressor 115 and thus the evaporation pressure of the first refrigeration cycle 10*a* may be less than that of the second refrigeration cycle 10*b*.

An example operation of the first refrigeration cycle 10*a* will be described in more detail below, with further reference to FIG. 3.

Since the temperature of cool air supplied to the freezing compartment 30 is less than the temperature of cool air supplied to the refrigerating compartment 20, the refrigerant evaporation pressure of the first evaporator 160 in the first refrigeration cycle 10*a* is less than the refrigerant evaporation pressure of the second evaporator 180 in the second refrigeration cycle 10*b*. Furthermore, since the first refrigerant branching from the valve device 140 flows into the auxiliary evaporator 170, the evaporation pressure of the auxiliary evaporator 170 may be equal to that of the first evaporator 160.

As shown in FIG. 3, the outlet-side refrigerant flow channel of the first evaporator 160 extends to the inlet side of the first compressor 111. Accordingly, the first refrigerant passing through the first evaporator 160 may be sucked into the first compressor 111. The outlet-side refrigerant flow channel of the first compressor 111 extends to the inlet side of the first condenser 120. Accordingly, the first refrigerant passing through the first compressor 111 may flow into the first condenser 120 to be condensed.

The outlet-side refrigerant flow channel of the first condenser 120 extends to the inlet side of the first expansion device 151. Accordingly, the first refrigerant passing through the first condenser 120 may flow to the first expansion device 151. The first expansion device 151 expands the first refrigerant which flows either into the first evaporator 160 or into the auxiliary evaporator 170. The first expansion device 151 may include a capillary tube.

Also as shown in the example of FIG. 3, the first refrigerant passing through the first expansion device 151 may flow, via the valve device 140, to the branched flow channel 156 and proceed to the auxiliary evaporator 170. The branched flow channel 156 guides inflow of first refrigerant to the auxiliary evaporator 170 and thus may be referred to as an "auxiliary evaporation flow channel."

The first refrigeration cycle 10*a* includes a coupler 100*a* provided at the suction side of the first compressor 111 and connected to the branched flow channel 156. The branched flow channel 156 may extend from the outlet side of the auxiliary evaporator 170 to the coupler 100*a*. Accordingly, the first refrigerant evaporated by the auxiliary evaporator 170 may flow to the coupler 100*a* through the branched flow channel 156 to be coupled with the first refrigerant evaporated by the first evaporator 160 and to be sucked into the first compressor 111.

The valve device 140 may operate to modulate the flow of the first refrigerant passing through the first expansion device 151 to the branched flow channel 156. For example, the valve device 140 may adjust flow of the first refrigerant such that the first evaporator 160 and the auxiliary evaporator 170 simultaneously operate, that is, such that the first refrigerant simultaneously flows into both the first evaporator 160 and the auxiliary evaporator 170. As another example, the first refrigerant passing through the valve device 140 may flow into at least one of the suction-side flow channel of the first evaporator 160 or the branched flow channel 156, and consequently to be evaporated by at least one of the first evaporator 160 or the auxiliary evaporator 170.

In the latter scenario, the valve device 140 may be selectively controlled such that the first refrigerant either flows only into the first evaporator 160 or flows into both the first evaporator 160 and the auxiliary evaporator 170, for example, according to a temperature increment of the refrigerating compartment 20. The temperature increment may be an amount by which the actual temperature of the refrigerating compartment 20 exceeds a nominal operating temperature.

For example, if the temperature increment of the refrigerating compartment 20 is less than a threshold temperature increment, the first refrigerant may be supplied to only the first evaporator 160 to cool the freezing compartment 30. That is, the first outlet 140*b* of the valve device 140 may be opened and the second outlet 140*c* may be closed. In this scenario, when the first outlet 140*b* is opened, the first refrigerant flows into the first evaporator 160 and generates cool air while passing through the first evaporator 160. The generated cool air may be used to cool the freezing compartment 30.

As another example, if the temperature increment of the refrigerating compartment 20 is equal to or greater than the threshold temperature increment, the first refrigerant may be supplied to both the first evaporator 160 and the auxiliary evaporator 170, thus cooling both the freezing compartment 30 and the refrigerating compartment 20, respectively. That is, both the first and second outlets 140*b* and 140*c* of the valve device 140 may be opened, thus supplying the first refrigerant to both the inlet-side flow channel of the evaporator 160 and the branched flow channel 156. In this scenario, when both the first and second outlets 140*b* and 140*c* of the valve 140 are opened, the first refrigerant may be divided into two flows. A first flow of the first refrigerant may flow in the branched flow channel 156 of the auxiliary evaporator 170 to pass through the auxiliary evaporator 170 and supply cool air into the refrigerating compartment 20. The second flow of the first refrigerant may flow into the first evaporator 160 to generate cool air that is used to cool the freezing compartment 30.

As described above, control of the valve device 140 may be selectively changed, for example, according to the temperature increment of the refrigerating compartment 20. Based on this selective control, the first refrigerant may flow to at least one of the inlet-side flow channel of the first evaporator 160 or the branched flow channel 156.

Accordingly, if the temperature increment of the refrigerating compartment 20 is less than a threshold temperature increment, the first refrigerant may be used to cool the freezing compartment 30 through the first evaporator 160 and, if the temperature increment of the refrigerating compartment 20 is equal to or greater than the threshold temperature increment, the first refrigerant may be used to cool both the freezing compartment 30 and the refrigerating compartment 20 through the first evaporator 160 and the auxiliary evaporator 170, respectively. As such, the refrigerator 10 may be configured to handle changing conditions, such as those caused by an overload of the refrigerating compartment 20, by utilizing an auxiliary supply of cool air provided through auxiliary evaporator 170 to selectively supplement the low evaporation pressure of the first evaporator 160.

An example operation of the second refrigeration cycle 10*b* will be described in more detail below, with further reference to FIG. 3.

Since the temperature of cool air supplied to the refrigerating compartment 20 is higher than that of cool air supplied to the freezing compartment 30, the refrigerant evaporation pressure of the second evaporator 180 may be higher than that of the first evaporator 160.

The outlet-side refrigerant flow channel of the second evaporator 180 extends to the inlet side of the second compressor 115. Accordingly, the second refrigerant passing through the second evaporator 180 may be sucked into the second compressor 115. The outlet-side refrigerant flow channel of the second compressor 115 extends to the inlet side of the second condenser 130. Accordingly, the second refrigerant compressed by the second compressor 115 may flow to the second condenser 130 to be condensed.

The outlet-side refrigerant flow channel of the second condenser 130 extends to the inlet side of the second expansion device 155. Accordingly, the second refrigerant condensed by the second condenser 130 may flow to the second expansion device 155 to be depressurized. The second expansion device 155 may include the capillary tube.

The second refrigerant flow channel 200 includes a second evaporator inlet flow channel 258 extending from the outlet side of the second expansion device 155 to the inlet side of the second evaporator 180. The second refrigerant depressurized by the second expansion device 155 may flow into the second evaporator 180 through the second evaporator inlet flow channel 258 to be evaporated by the second evaporator 180. Cool air generated by the second evaporator 180 may be supplied to the refrigerating compartment 20 to cool the refrigerating compartment 20.

The refrigerator 10 may further include fans, such as fans 125, 135, 165, 175 and 185 provided at one sides of the evaporators 160, 170 and 180 and the first and second condensers 120 and 130 to blow air, as shown in the example of FIG. 3. The fans 125, 135, 165, 175 and 185 may include a first condensing fan 125 provided at one side of the first condenser 120, a second condensing fan 135 provided at one side of the second condenser 130, a first evaporation fan 165 provided at one side of the first evaporator 160, an auxiliary evaporation fan 175 provided at one side of the auxiliary evaporator 170 and a second evaporation fan 185 provided at one side of the second evaporator 180. The auxiliary evaporation fan 175 may operate to blow cool air of the refrigerating compartment 20 toward the auxiliary evaporator 170.

More specifically, heat exchange ability of the first evaporator 160, the auxiliary evaporator 170, and the second evaporator 180 may be changed according to the rotation speeds of the plurality of evaporation fans 165, 175 and 185 of the respective evaporators. For example, if a large amount of cool air is to be utilized due to operation of the first evaporator 160, the rotation speed of the first evaporation fan 165 may be increased and the rotation speed of the first condensing fan 125 may be maintained or increased. In contrast, if a sufficient amount of cool air is present, the rotation speed of the first evaporation fan 165 may be decreased and the rotation speed of the first condensing fan 125 may be maintained or decreased.

Similarly, if a large amount of cool air is to be utilized due to operation of the second evaporator 180, the rotation speed of the second evaporation fan 185 may be increased and the rotation speed of the second condensing fan 135 may be maintained or increased. In contrast, if a sufficient amount of cool air is present, the rotation speed of the second evaporation fan 185 may be decreased and the rotation speed of the second condensing fan 135 may be maintained or decreased. As such, the rotation speeds of the evaporation fans 165, 175, and 185 of the respective evaporators, or the rotation speeds of the condensing fans 125 and 135 of the respective condensers may be selectively adjusted according to an overload scenario of the freezing compartment 30 or the refrigerating compartment 20.

The refrigerator 10 may further include a controller 300 for controlling driving of the first refrigeration cycle 10*a* and the second refrigeration cycle 10*b*. More specifically, the controller 300 may control operation of the first compressor 111 of the first refrigeration cycle 10*a* and the second compressor 115 of the second refrigeration cycle 10*b*. The controller 300 may also control the valve device 140.

Hereinafter, an example of controlling the refrigerator 10 will be described in greater detail with reference to FIG. 4.

Figure 4:
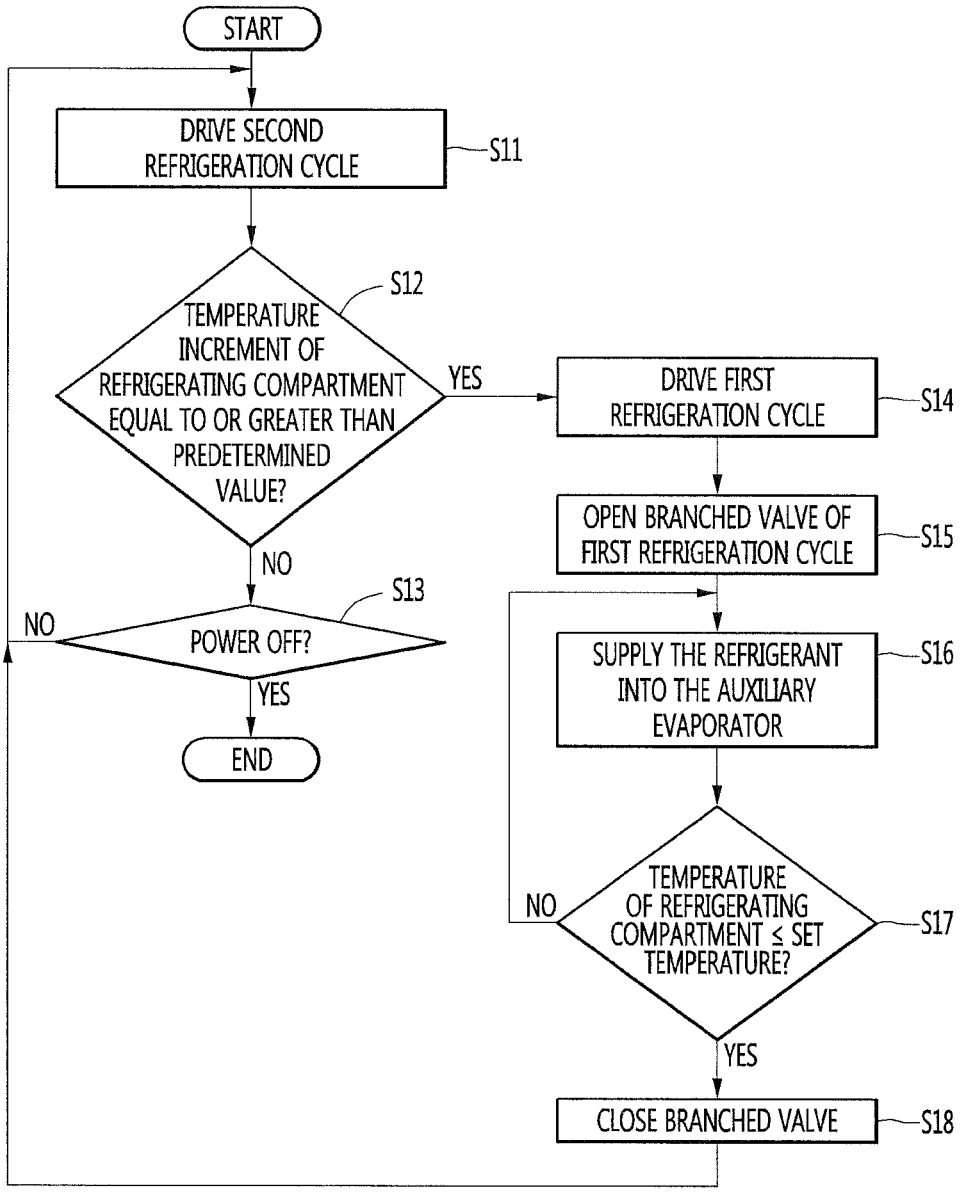
FIG. 4 is a flowchart illustrating an example of controlling a refrigerator according to some implementations.

FIG. 4 is a flowchart illustrating an example of controlling a refrigerator according to some implementations.

First, the second compressor 115 is driven to drive the second refrigeration cycle 10*b*. For example, the second refrigeration cycle 10*b* for cooling the refrigerating compartment 20 may be driven (S11).

Thereafter, a determination is made as to whether the temperature increment of the refrigerating compartment 20 is equal to or greater than a predetermined value, such as a threshold temperature increment. For example, when the refrigerating compartment door 25 is opened or hot food is inserted into the refrigerating compartment 20, the temperature increment of the refrigerating compartment 20 may be equal to or greater than the predetermined value (S12).

If the temperature increment of the refrigerating compartment 20 is less than the predetermined value, a determination is made as to whether the refrigerator is powered off. If the refrigerator is not powered off, then the second refrigeration cycle 10*b* may be continuously driven. For example, if the temperature increment of the refrigerating compartment 20 is less than the predetermined value, then a determination is made that the refrigerating compartment 20 is not in an overloaded state, and the refrigerator 10 performs a normal operation of the second refrigeration cycle 10*b*. The temperature increment may be an amount of increase in temperature relative to a nominal temperature, such as a temperature that has been set as the operating temperature, of the refrigerating compartment 20.

During normal operation of the second refrigeration cycle 10*b* for the refrigerating compartment 20, the second refrigeration cycle 10*b* may continuously operate the second compressor 115. For example, the second refrigeration cycle 10*b* may continuously drive the second compressor 115 regardless of whether the temperature of the refrigerating compartment 20 is less than or greater than a nominal or set temperature. The second compressor 115 may be a low-cooling-capacity compressor and thus, in such scenarios, continuous driving of the second compressor 115 may have less of an impact on power consumption, compared with higher-cooling-capacity systems.

As an illustrative example, the nominal or set temperature of the refrigerating compartment 20 may be 2 degrees Celsius (° C.) and the threshold temperature increment may be 1.5° C. As long as the temperature of the refrigerating compartment 20 remains within the nominal temperature by less than the threshold temperature increment, that is, as long as the temperature remains equal to or less than 3.5° C., then the normal operation of the second refrigeration cycle 10*b* is performed (S13). In this scenario, second compressor 115 may be sufficient to provide cooling for the refrigerating compartment 20.

In contrast, if the temperature of the refrigerating compartment 20 increases beyond the nominal temperature by an amount equal to or greater than the threshold temperature increment, that is, if the temperature exceeds 3.5° C., then the refrigerating compartment 20 may be in an overloaded state. Accordingly, an overload handling operation may be performed whereby, in addition to the second refrigeration cycle 10*b*, the first refrigeration cycle 10*a* may also be utilized to provide additional cooling air for the refrigerating compartment 20. In such scenarios, in addition to the second compressor 115 driving the second refrigeration cycle 10*b*, the first compressor 111 may additionally be driven to drive the first refrigeration cycle 10*a*, thereby cooling the freezing compartment 30.

To provide this additional cooling, valve device 140 may be controlled to open both the first and second outlets 140*b* and 140*c*. The refrigerant depressurized by the first expansion device 151 may flow into the valve device 140 through the inlet 140*a* and may be discharged through both the first and second outlets 140*b* and 140*c*. The first refrigerant discharged through the first and second outlets 140*b* and 140*c* may flow to the first evaporator 160 and the branched flow channel 156. As such, at least some of the first refrigerant may flow into the first evaporator 160 and the remaining first refrigerant may flow into the auxiliary evaporator 170. The auxiliary evaporator 170 is provided adjacent to the refrigerating compartment 20 and cool air generated by the auxiliary evaporator 170 may be supplied to the refrigerating compartment 20 according to a driving operation of the auxiliary evaporation fan 175. Thus, the temperature of the refrigerating compartment 20 may be decreased.

Utilizing the above systems and techniques, at least part of the cooling capacity of the first refrigeration cycle 10*a* may be supplied to the second refrigeration cycle 10*b* to provide additional cooling for the refrigerating compartment 20. This may reduce the need for using a higher-cooling capacity second compressor 115 to continuously provide cooling for the refrigerating compartment 20, which may help conserve energy. As such, addressing the problem of excessive temperature in the refrigerating compartment 20, for example due to an overloaded state, may not necessarily require that the second compressor 115 be a high-cooling-capacity compressor. Instead, as described above, the second compressor 115 may be a low-cooling capacity compressor, and additional cooling may be supplied selectively and temporarily by routing a portion of cold air from the first refrigeration cycle 10*a* (e.g., from the first compressor 111 that provides cool air into the freezing compartment 30) into the refrigerating compartment 20 (S14, S15 and S16).

The additional cooling that is routed from the first refrigeration cycle 10*a* may be supplied to the refrigerating compartment 20 until one or more criteria have been satisfied, at which point the additional cooling may be discontinued. For example, the additional cooling may be supplied until the temperature of the refrigerating compartment 20 is less than the nominal or set temperature.

In this scenario, if the temperature of the refrigerating compartment 20 decreases to less than the nominal or set temperature during the process of driving the first refrigeration cycle 10*a* to provide additional cooling for the refrigerating compartment 20, then the control state of the valve device 140 may be changed. For example, the first outlet 140*b* may be opened and the second outlet 140*c* may be closed.

Accordingly, in the first refrigeration cycle 10*a*, the first refrigerant that is depressurized by the first expansion device 151 may flow into the valve device 140 through the inlet 140*a* and flow to the first evaporator 160. However, the flow of the first refrigerant in the branched flow channel 156 may be restricted or stopped (S17 and S18).

If the temperature of the refrigerating compartment 20 is greater than the nominal or set temperature, then the control state of the valve device 140 may be maintained with both first and second outlets 140*b* and 140*c* opened such that first refrigerant continuously flows into the auxiliary evaporator 170. For convenience of notation in this disclosure, a state in which both first and second outlets 140*b* and 140*c* of the valve device 140 are opened is herein referred to as a "first operation state," and a state in which the second outlet 140*c* is closed and the first outlet 140*b* is opened is herein referred to as a "second operation state".

Although the flowchart in FIG. 3 illustrates that control of the first refrigeration cycle 10*a* is changed based on driving of the second refrigeration cycle 10*b*, implementations are not limited thereto. As an example, in some implementations, the first refrigeration cycle 10*a* may be driven independently from the second refrigerating cycle 10*b* according to the temperature of the freezing compartment 30. In such scenarios, the first compressor 111 may be driven to supply cool air when the temperature of the freezing compartment 30 is equal to or greater than the nominal or set temperature of the freezing compartment 30, regardless of the temperature of the refrigerating compartment 20. As another example, in some implementations, the first compressor 111 may be driven to supply cool air based on both temperatures of freezing compartment 30 and refrigerating compartment 20.

Therefore, by utilizing the systems and techniques described above, if the temperature increment of the refrigerating compartment 20 is equal to or greater than the threshold temperature increment, which may occur in an overloaded state of the refrigerating compartment 20, then at least a portion of the first refrigerant circulated in the first refrigerating cycle 10*a* may be supplied to the auxiliary evaporator 170 to cool the refrigerating compartment 20. Accordingly, as explained above, this technique may reduce the need for using a high-cooling capacity compressor for coping with overload of the refrigerating compartment 20.

Furthermore, due to the low-cooling capacity of the second compressor 115, the second compressor 115 may be operated continuously to provide cooling for the refrigerating compartment 20, without utilizing an excessive amount of energy. Such continuous operation of the second compressor 115 may help reduce or prevent deterioration in cycle efficiency caused by repeatedly turning the second compressor 115 on and off. As such, continuous operation of the low-cooling capacity of the second compressor 115 may help reduce fluctuations in the internal temperature of the refrigerating compartment 20, improving operating efficiency as well as end-user satisfaction.

Hereinafter, with reference to FIGS. 5-8, comparison is made between refrigerator cycle efficiency for 2-cycle continuous operation, as described above, and refrigerator cycle efficiency for 2-cycle intermittent on/off operation.

Figure 5:
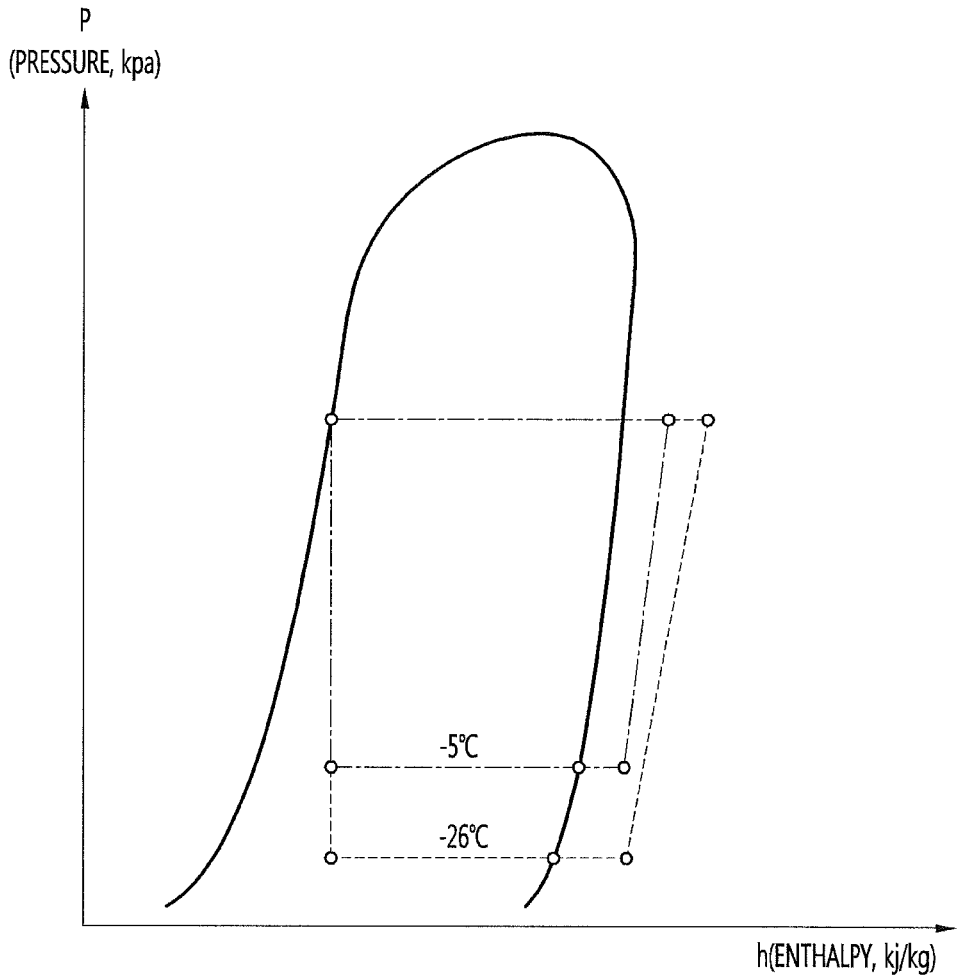
FIG. 5 is a graph showing an example of a P-H curve showing change in pressure P and enthalpy h upon conventional 2-cycle intermittent operation according to some implementations.
Figure 6:
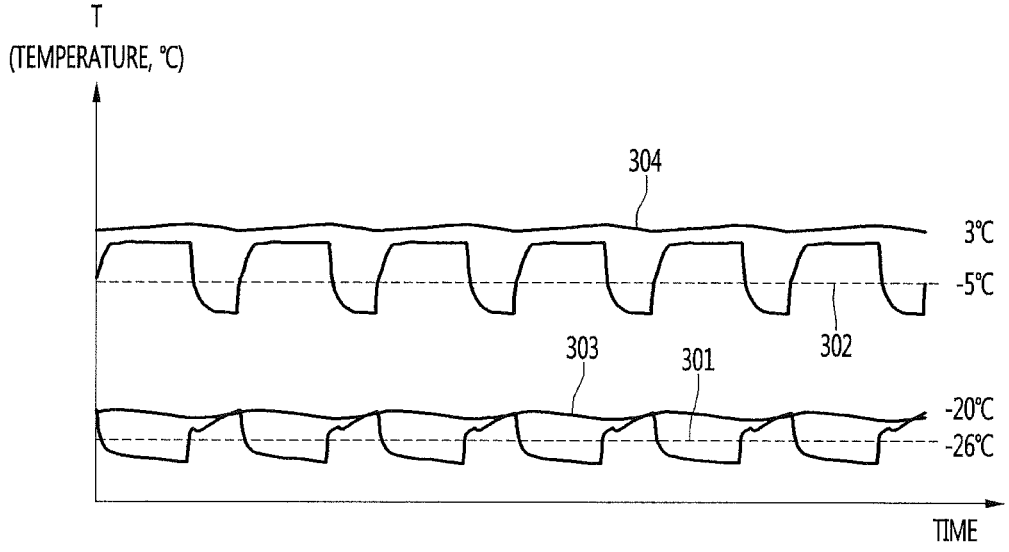
FIG. 6 is a graph showing an example of an evaporation temperature of an evaporator and an internal temperature of a compartment upon conventional 2-cycle intermittent operation according to some implementations.
Figure 7:
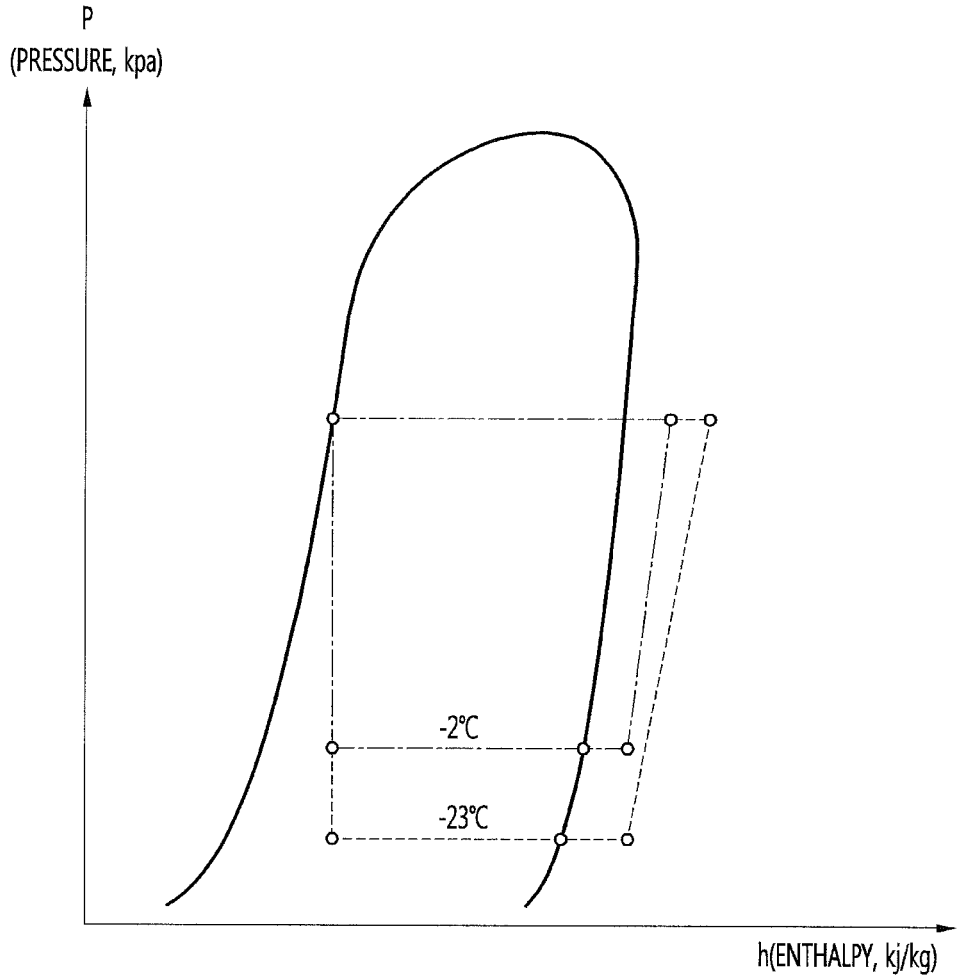
FIG. 7 is a graph showing an example of a P-H curve showing change in pressure and enthalpy upon 2-cycle continuous operation according to some implementations.
Figure 8:
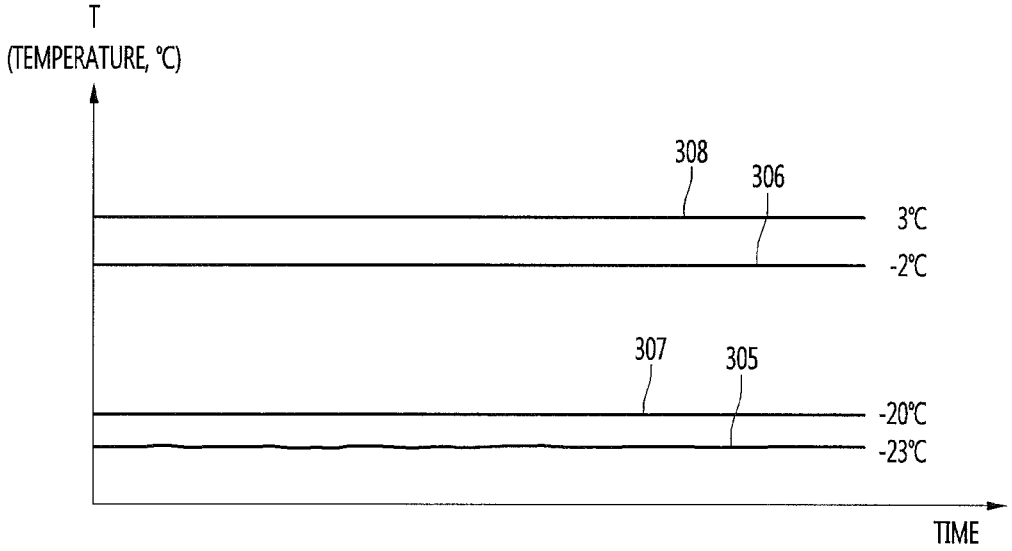
FIG. 8 is a graph showing an example of an evaporation temperature of an evaporator and an internal temperature of a compartment upon 2-cycle continuous operation according to some implementations.

FIG. 5 is a graph showing an example of a P-H curve showing change in pressure P and enthalpy h upon conventional 2-cycle intermittent operation. FIG. 6 is a graph showing an example of an evaporation temperature of an evaporator and an internal temperature of a compartment upon 2-cycle intermittent on/off operation. FIG. 7 is a graph showing an example of a P-H curve showing change in pressure and enthalpy upon 2-cycle continuous operation as described above. FIG. 8 is a graph showing an example of an evaporation temperature of an evaporator and an internal temperature of a compartment upon 2-cycle continuous operation as described above.

First, referring to examples of FIGS. 5 and 6, in a 2-cycle intermittent on/off operation, the evaporation temperature 301 of the first refrigeration cycle for cooling the freezing compartment is approximately −26° C. and the evaporation temperature 302 of the second refrigeration cycle for cooling the refrigerating compartment is about −5° C. The internal temperature 303 of the freezing compartment is about −20° C. and the internal temperature 304 of the refrigerating compartment is about 3° C.

As such, in this example of a 2-cycle intermittent on/off operation, a difference between the evaporation temperature 301 of the first refrigeration cycle and the internal temperature 303 of the freezing compartment is approximately 6° C. and a difference between the evaporation temperature 302 of the second refrigeration cycle and the internal temperature 304 of the refrigerating compartment is approximately 8° C.

In contrast, referring to the examples of FIGS. 7 and 8, in a 2-cycle continuous operation as describe above, the evaporation temperature 305 of the first refrigeration cycle for cooling the freezing compartment 30 is approximately −23° C. and the evaporation temperature 306 of the second refrigeration cycle for cooling the refrigerating compartment 20 is approximately −2° C. The internal temperature 307 of the freezing compartment 30 is approximately −20° C. and the internal temperature 308 of the refrigerating compartment 20 is approximately 3° C.

As such, in this example of a 2-cycle continuous operation, a difference between the evaporation temperature 305 of the first refrigeration cycle and the internal temperature 307 of the freezing compartment is approximately 3° C. and a difference between the evaporation temperature 306 of the second refrigeration cycle and the internal temperature 308 of the refrigerating compartment is approximately 5° C.

As a result, in these examples, the difference between the evaporation temperature of the evaporator and the internal temperature of the compartment is approximately 6 to 8° C. in the conventional 2-cycle intermittent on/off operation and approximately 3 to 5° C. in the 2-cycle continuous operation. That is, in the 2-cycle continuous operation described above, the difference between the evaporation temperature and the internal temperature of the compartment is improved by approximately 3° C. as compared to a 2-cycle intermittent on/off operation, thereby improving refrigerator cycle driving efficiency.

Accordingly, the systems and techniques described herein may improve the refrigerator cycle driving ability, and reduce relative power consumption with the same driving ability.

What is claimed is:

1. A refrigerator comprising:

a main body defining therein a freezing compartment and a refrigerating compartment;

a first refrigeration cycle system comprising:

a first compressor configured to compress a first refrigerant;

a first condenser configured to condense the first refrigerant discharged from the first compressor;

a first capillary tube configured to expand the first refrigerant discharged from the first condenser;

a first evaporator configured to evaporate the first refrigerant passing through the first capillary tube and to supply cool air to the freezing compartment;

a branched flow channel branched from an outlet side of the first capillary tube; and an auxiliary evaporator provided in the branched flow channel and configured to supply the cool air to the refrigerating compartment, a second refrigeration cycle system comprising:

a second compressor configured to compress a second refrigerant;

a second condenser configured to condense the second refrigerant discharged from the second compressor;

a second capillary tube configured to expand the second refrigerant discharged from the second condenser; and a second evaporator configured to evaporate the second refrigerant passing through the second capillary tube and to supply the cool air to the refrigerating compartment, a first evaporator inlet flow channel extending from the first capillary tube to the first evaporator; and a three-way valve provided in the first evaporator inlet flow channel and connected to the branched flow channel, the three-way valve comprising:

an inlet connected to the outlet side of the first capillary tube;

a first outlet connected to an inlet side of the first evaporator;

a second outlet connected to an inlet side of the auxiliary evaporator of the first refrigeration cycle system; and at least one processor configured to determine a temperature of the refrigerating compartment and control the three-way valve based on the temperature of the refrigerating compartment, wherein the at least one processor is further configured to:

determine whether the temperature of the refrigerating compartment does not exceed a reference temperature by an amount greater than or equal to a threshold temperature increment; and based on a determination that the temperature of the refrigerating compartment does not exceed the reference temperature by the amount greater than or equal to the threshold temperature increment, control a first operation of the second refrigeration cycle system, and wherein the first operation of the second refrigeration cycle system comprises continuously driving the second compressor.

2. The refrigerator according to claim 1, wherein the branched flow channel extends from the three-way valve to the auxiliary evaporator.

3. The refrigerator according to claim 1, wherein the first refrigeration cycle system further comprises a coupler provided at a suction side of the first compressor and connected to the branched flow channel, and wherein the branched flow channel further extends from the auxiliary evaporator of the first refrigeration cycle system to the coupler.

4. The refrigerator according to claim 1, wherein the at least one processor is further configured to:

determine that the temperature of the refrigerating compartment exceeds the reference temperature by the amount greater than or equal to the threshold temperature increment; and based on the determination that the temperature of the refrigerating compartment exceeds the reference temperature by the amount greater than or equal to the threshold temperature increment, perform a first operation of the first refrigeration cycle, wherein the first operation of the first refrigeration cycle comprises opening the first outlet and the second outlet of the three-way valve.

5. The refrigerator according to claim 4, wherein the at least one processor is further configured to:

during the first operation of the first refrigerating cycle, determine that the temperature of the refrigerating compartment is equal to or less than the reference temperature; and based on a determination that the temperature of the refrigerating compartment is equal to or less than the reference temperature during the first operation of the first refrigerating cycle, open the first outlet of the valve device and close the second outlet of the valve device.

6. The refrigerator according to claim 1, wherein the auxiliary evaporator is provided adjacent to the second evaporator.

7. The refrigerator according to claim 1, wherein the first refrigeration cycle is driven independently from the second refrigerating cycle according to a temperature of the freezing compartment.

8. The refrigerator according to claim 1, wherein the first compressor is configured to supply the cool air when the temperature of the freezing compartment is equal to or greater than a nominal or set temperature of the freezing compartment.

9. The refrigerator according to claim 1, wherein the first compressor is configured to supply the cool air based on both temperatures of the freezing compartment and refrigerating compartment.

* * * * *